United States Patent [19]

Hayes et al.

[11] Patent Number: 4,891,021

[45] Date of Patent: Jan. 2, 1990

[54] HIGH DENSITY SOCKET CONTACT RECEPTACLE

[75] Inventors: Earl J. Hayes, Mechanicsburg, Pa.; Allen F. VanDerStuyf, Kernersville, N.C.

[73] Assignee: AMP Incorporated, Harrisburg, Pa.

[21] Appl. No.: 331,050

[22] Filed: Mar. 28, 1989

Related U.S. Application Data

[63] Continuation of Ser. No. 151,040, Feb. 1, 1988, abandoned, Continuation-in-part of Ser. No. 873,652, Jun. 12, 1986, Pat. No. 4,722,704.

[51] Int. Cl.[4] ..... H01R 13/40

[52] U.S. Cl. ..... 439/599; 439/595; 439/752; 439/744

[58] Field of Search ..... 439/733–752, 439/595, 596, 599, 351–358

[56] References Cited

U.S. PATENT DOCUMENTS

| | | | |
|---|---|---|---|
| 3,012,159 | 12/1961 | Druesedow | 310/71 |
| 3,101,229 | 8/1963 | Yopp | 339/59 |
| 3,165,369 | 1/1965 | Maston | 339/59 |
| 3,440,596 | 4/1969 | Frompavicz | 339/206 |
| 3,517,370 | 6/1970 | Poingt | 339/59 |
| 3,648,213 | 3/1972 | Kobler | 339/59 R |
| 3,937,545 | 2/1976 | Cairns et al. | 339/60 |
| 3,982,805 | 9/1976 | Irie | 339/59 |
| 4,013,331 | 3/1977 | Kobler | 339/59 |
| 4,323,296 | 4/1982 | Andoh | 439/595 |
| 4,557,542 | 12/1985 | Coller et al. | 339/59 |
| 4,588,242 | 5/1986 | McDowell et al. | 339/59 |
| 4,660,915 | 4/1987 | Mantlik | 439/595 |
| 4,711,508 | 12/1987 | Sueyoshi | 439/595 |
| 4,752,251 | 6/1988 | Kato et al. | 439/752 |

FOREIGN PATENT DOCUMENTS 1030091 5/1966 United Kingdom .

*Primary Examiner*—David Pirlot

*Attorney, Agent, or Firm*—Robert W. Pitts; Eric J. Groen

[57] ABSTRACT

An electrical connector assembly includes a mating receptacle and header. The receptacle includes contacts having beam members integral with and extending between a forward and rearward cylindrical portion. The beam members are formed in opposed pairs with constricted portions at different axial locations. The spacing between the opposed pairs of beams is less than the widths of the beams. The header includes rows of square posts for mating with the socket contacts, the rows of posts being axially offset from each other.

3 Claims, 13 Drawing Sheets

72a
70a
70a
72a 66a
90
66a 68a
68a 76a
66a
72a
76a
66a
72a

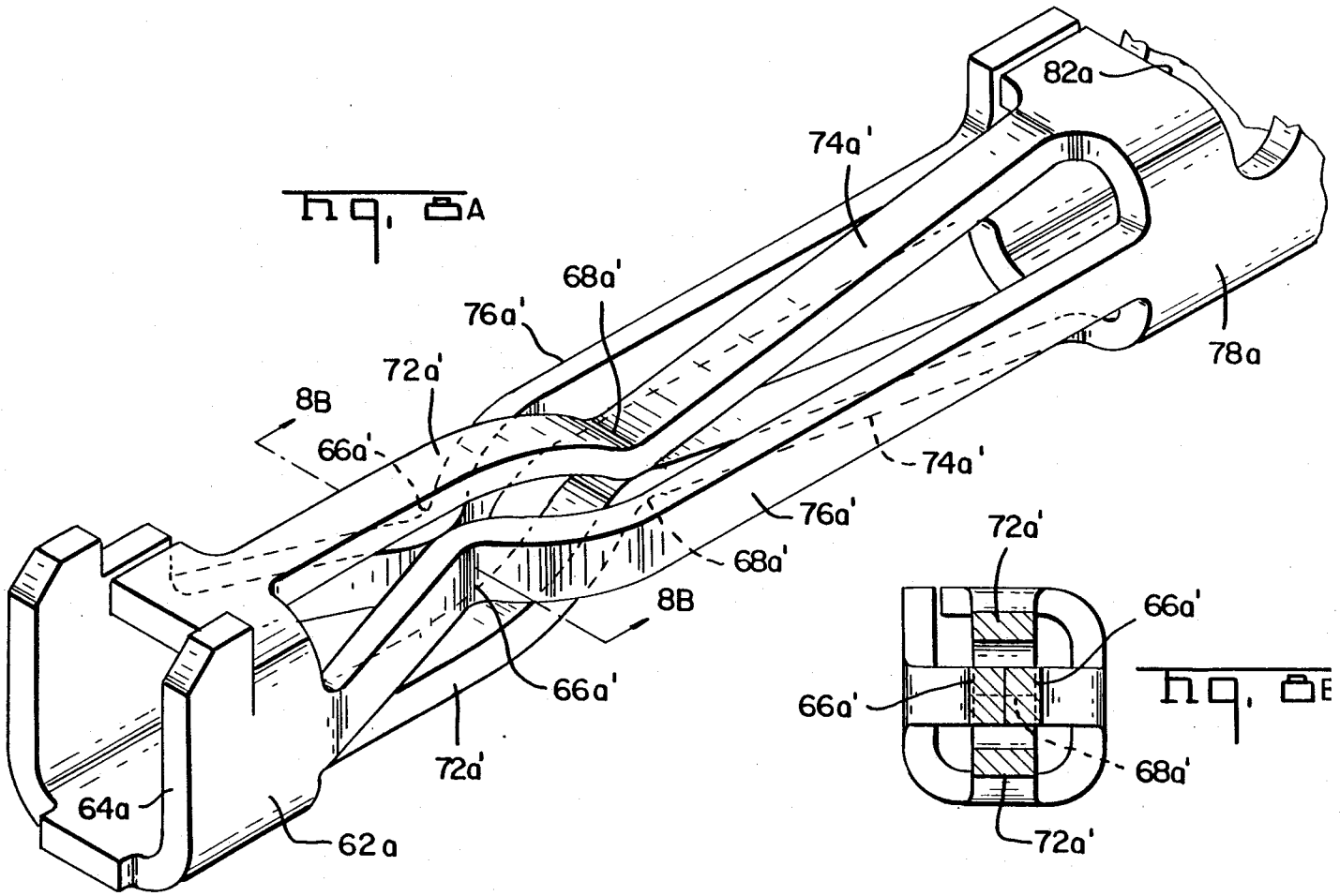
78a
82a
74a'
74a'
76a'
68a'
68a'
76a'
72a'
66a'
8B
8B
66a'
72a'
62a
64a
66a'
68a'
72a'
72a'
66a'
A
E

HIGH DENSITY SOCKET CONTACT RECEPTACLE

CROSS REFERENCE TO PENDING APPLICATIONS

BACKGROUND OF THE INVENTION

This application is a continuation of prior co-pending application Ser. No. 151,040 filed Feb. 1, 1988, now abandoned, which was a continuation-in-part of prior co-pending application Ser. No. 873,652 Filed June 12, 1986, now U.S. Pat. No. 4,722,704.

1. Field of the Invention

The instant invention relates to a high density receptacle having socket contacts, the receptacle interconnectable with pin contacts mounted within a header.

2. Description of the Prior Art

Headers and panel boards containing a rectangular matrix of electrically conductive schemes are used in a variety of applications. The posts are generally aligned in a closely spaced array or matrix of identical posts. These posts normally have either a square or a round cross-section. Conventional applications in which an array of posts might be employed would include automotive applications, computers, televisions and telecommunicatons systems.

Posts in an array are generally closely spaced and this spacing is generally dictated by considerations other than the geometry of the connector. Therefore, terminals and connectors must be designed to function on the centerline spacings dictated. Even where the past array and the connector can be designed as a system, there is a real need to employ standard rather than unique configurations.

A conventional approach to interconnecting a wire to an individual posts or pin in an array of posts is to employ a contact socket of the type generally shown in U.S. Pat. No. 3,317,887. A contact of this type includes four beams oriented in opposed pairs of beams. These beams are stamped from an integral spring metal blank and the blank is formed around a central axis to form a box or cylindrical configuration. The beams are inwardly formed with the interior of each beam having a generally convex configuration. Constructed areas of each beam are at the same axial location and upon insertion of a post or pin, the beams are simultaneously outwardly deflected and points of contact are established at the constricted points. However, since all four beams are simultaneously deflected, the relative contact force can be quite high. Deflection of the beams is also limited since the spacing between the beams in the constricted area of each pair of opposed beams can be no closer than the widths of the adjacent beams, thus the normal force on the post in minimized.

SUMMARY OF THE INVENTION

It is an object of the instant invention to design a socket contact for interconnection with a post member, the contact design allowing for a high density array of connections.

It is an object of the instant invention to design a socket contact having a high normal force given the small envelope of the contact.

It is an object of the instant invention to design a socket contact having a lower insertion force with a post member.

The instant invention accomplishes the objectives by having a socket contact with beam members integral with and extending between a forward and rearward cylindrical portion, the beam members formed in pairs of opposing members, the beams being formed inwardly forming a first and second constricted portion, the first and second constrictions being axially offset, with the spacing between the opposed beams being less than the width of the beams. The deflection of the beams upon insertion of a post is greater than if the constricted portions were axially aligned leading to a relatively high normal force on the past member. As the constricted portions are axially offset, the insertion force is thereby minimized.

BRIEF DESCRIPTION OF THE DRAWINGS

FIG. 3 is a perspective view of the receptacle cutaway with the socket contacts inserted and the terminal positioning insert exploded away.

FIG. 8A is a perspective view of an alternate embodiment of the contact.

FIG. 8B is a cross-section through lines 8B—8B of FIG. 8A.

DETAILED DESCRIPTION OF THE PREFERRED EMBODIMENT

Figure 1:
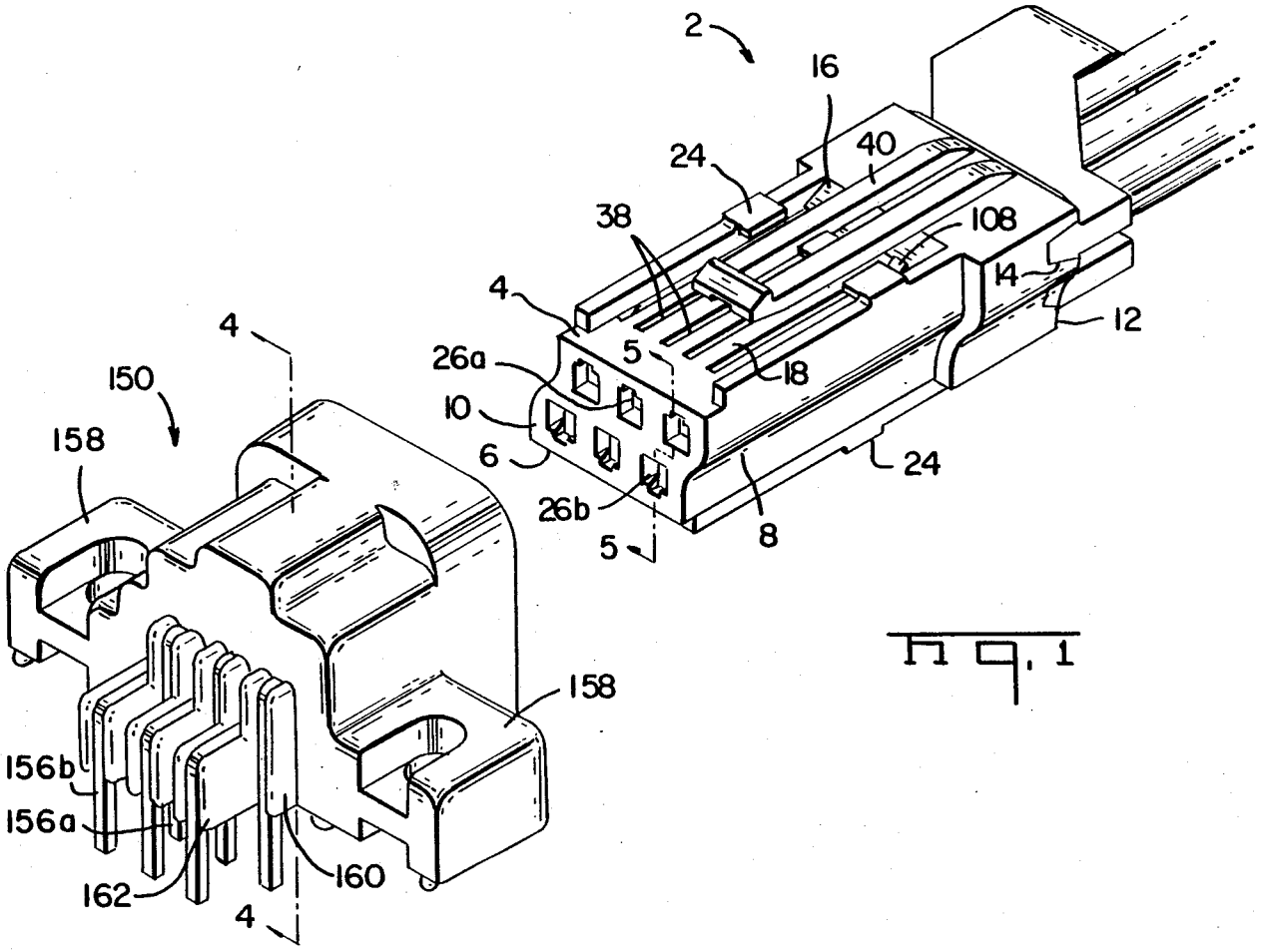
FIG. 1 is a perspective vie of the first embodiment of a receptacle and header.
Figure 2:
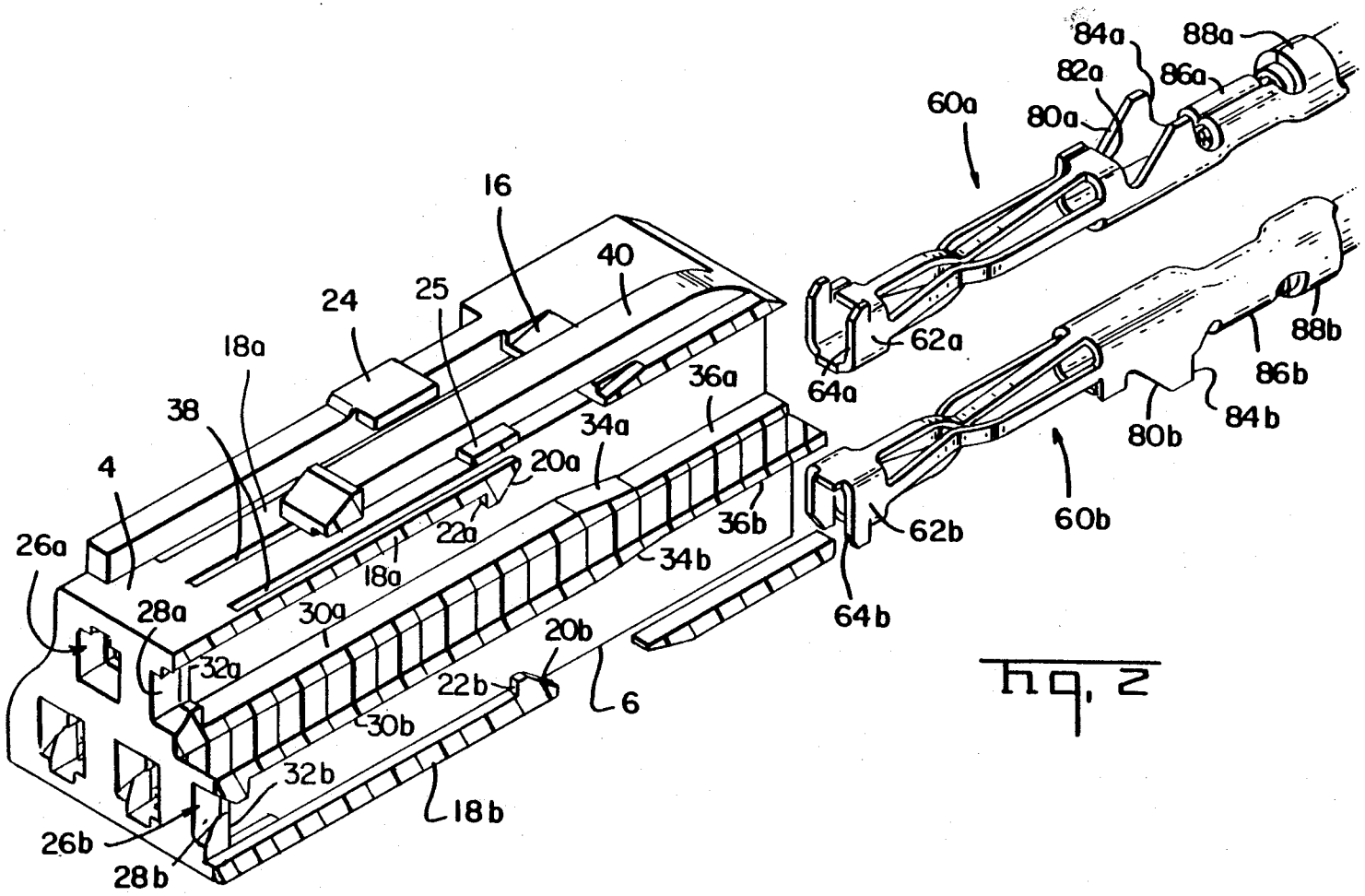
FIG. 2 is a perspective view of the receptacle cutaway with the socket contacts exploded away.
Figure 7:
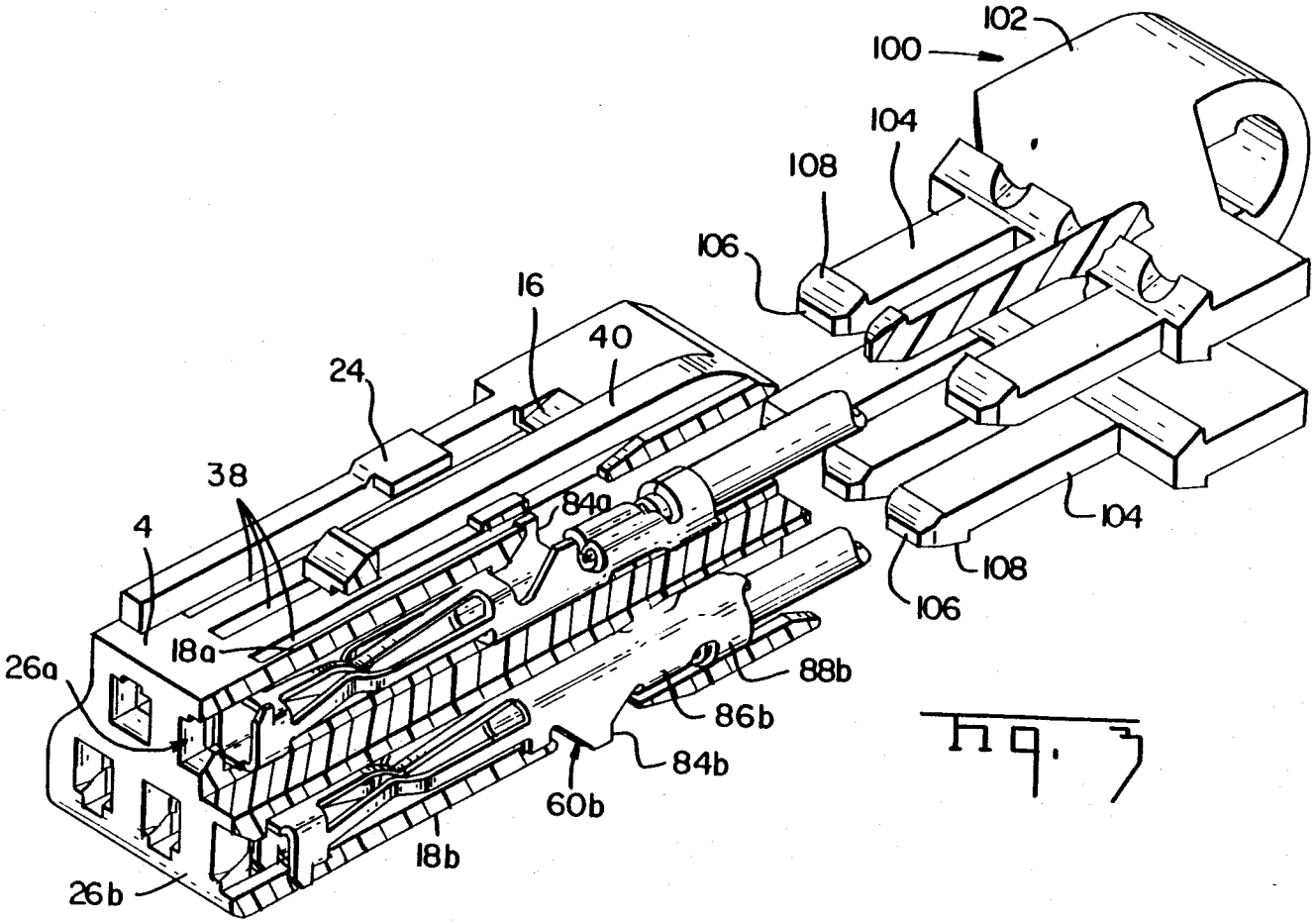
FIG. 7A is a cross-section of the contact through lines 7A—7A of FIG. 6.
FIG. 7B is a cross-section of the contact through lines 7B—7B of FIG. 6.
FIG. 7C is a cross-section of the contact through lines 7C—7C of FIG. 6.
FIG. 7D is a view similar to FIG. 7B with a post inserted.

Referring to FIG. 1, there is shown a multicontact electrical connector in the form of a high density socket contact receptacle 2 interconnectable with a header assembly 150. The receptacle 2 comprises an insulative housing having a top wall 4, bottom wall 6, side walls 8, front mating face 10, and rear contact receiving face 12. Profiled in the contact receiving face 12 are insert receiving openings 14. Extending from the front mating face 10 and extending rearwardly to the rear contact receiving face are a plurality of upper contact receiving apertures or cavities 26a and a plurality of lower contact receiving apertures or cavities 26b. Overlying each of the top contact receiving apertures 26a is a latch member 18a as part of the top wall 4, each latch having a window 38 along each side. As best shown in FIG. 2, the contact latch member 18a includes a ramp surface 20a and a locking surface 22a. Still referring to FIG. 2, contact receiving aperture 26a includes a pin receiving chamfer 28a defining a constricted opening, a shoulder 32a, a first bore 30a, a frustoconical surface 34a, and a second bore 36a. The lower contact receiving aperture has like constituent components. Contact latches 18b are part of the bottom wall 6 and extend upwardly into the lower contact receiving apertures 26b. Contact latches 18a are likewise part of the top wall 4. As best shown in FIG. 2, latch 18b includes ramp surface 20b and locking surface 22b. Each contact latch 18a, 18b comprises a contilever member having a fixed end more closely adjacent the mating face 10 and a free end between the mating face 10 and the rear contact receiving face 12. The ramp surfaces 20a, 20b faces the free end of the contilever contact latch 18a, 18b and the locking surfaces 22a, 22b are adjacent the corresponding ramp surface 20a, 20b and between the fixed end and the ramp surface 20a, 20b or each contact latch 18a, 18b. The ramp surfaces 20a, 20b and the locking surfaces 22a, 22b each extend inwardly from the contact latches 18a, 18b into the cavities 26a, 26b. Referring again to FIG. 1, receptacle 2 also includes anti-overstress features 24 for latches 18a and 18b and also a receptacle latch 40. Overstress member 24 comprises transversely extending tabs spaced from the corresponding top wall 4 and bottom wall 6. Consequently, the overstress member 24 is spaced from the exterior surface of at least one of the corresponding cantilever contact latches 18a, 18b. The overstress members 24 overlap the corresponding contact latch 18a, 18b and prevent damage to the contact latches due to excessive deflection. An auxiliary overstress member 25 extends laterally from the side of at least one arm of receptacle latch 40, and is similarly positioned in overlapping, spaced relation to at least one contact latch 18a to prevent excessive deflection.

Referring to FIG. 3, the receptacle 2 is shown with the contact terminals or contacts 60a, 60b positioned within their respective apertures 26a, 26b and the terminal positioning insert or secondary lock 100 exploded away from the contact receiving face 12. The terminal positioning insert 100 includes a body portion 102, individual finger members 104, each finger 104 having a bearing surface 106 at its end. Each end finger 104 also includes a latch member 108.

Figure 6:
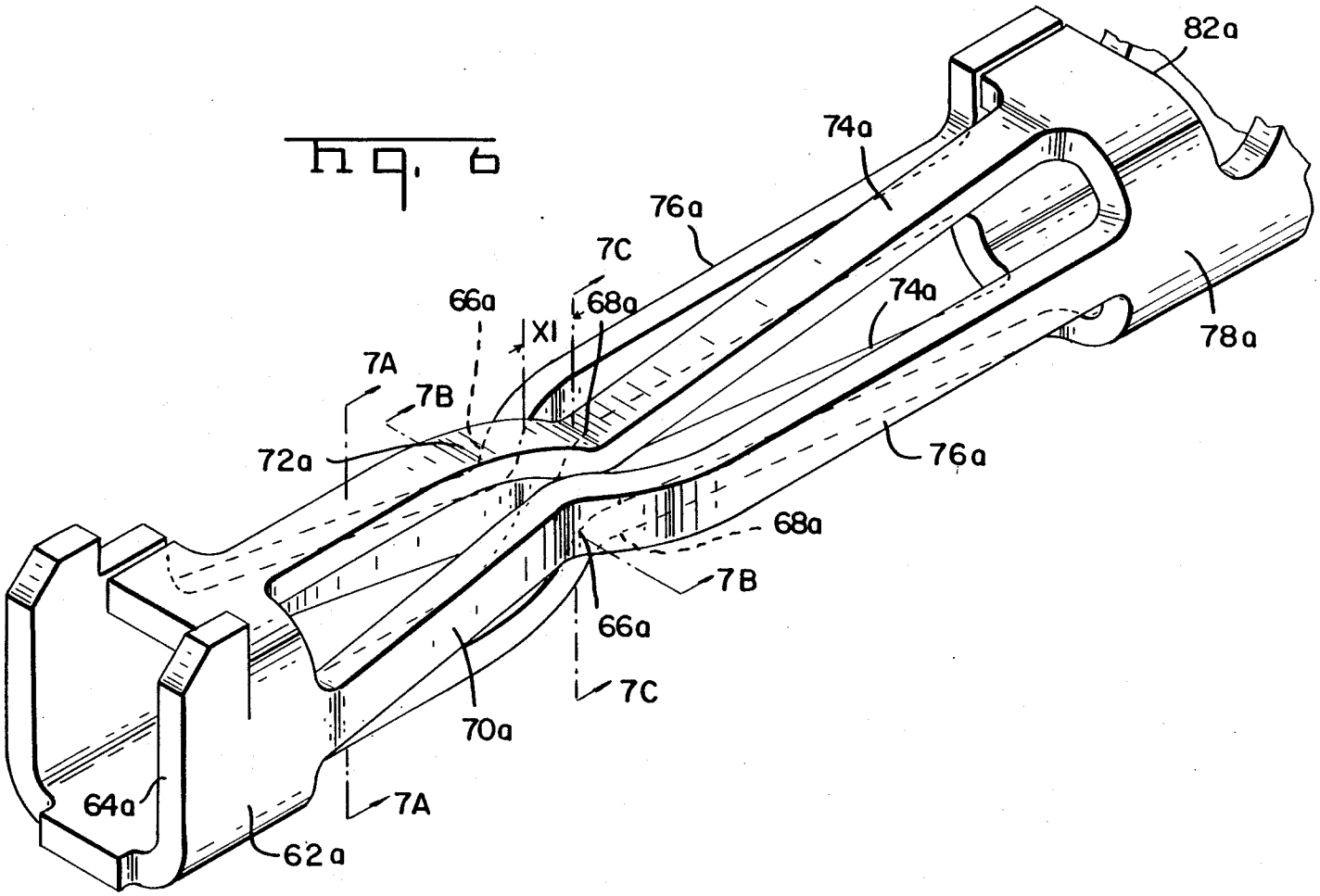
FIG. 6 is a perspective view of the preferred embodiment of the socket contact.

Referring now to FIG. 6, the contact 60a is shown in greater detail, although contact 60b has like constituent components. The contact 60a comprises a forward cylindrical portion 62a, a first constricted portion 66a, a second constricted portion 68a and a rear cylindrical portion 78a. As shown in FIG. 2, the contact 60a also comprises a ramped surface 80a, a locking surface 84a, a wire terminating section 86a, and a strain relief portion 88a. The constricted portions 66a and 68a are each located in a contact portion of each contact terminal 60a and the wire terminating section 86a and strain relief portions 88a each form a conductor termination portion. Contact terminal 60b has similar contact portions and conductor termination portions. Referring again to FIG. 6, the first constricted portion 66a includes two beams extending between the first cylindrical portion 62a and rearward cylindrical portion 78a formed inwardly and includes a straight portion 70a and a bowed section 76a. The second constricted portion 68a includes two beams extending between the first cylindrical portion 62a and the rearward cylindrical portion 78a including a bowed section 72a and a straight portion 74a. It should be noticed that the first constricted portion 66a includes a straight portion 70a extending from the forward cylindrical portion 62a whereas the second constricted portion 68a includes a bowed section 72a extending from the forward cylindrical portion 62a. It should also be noticed that the first constricted portion 66a includes a bowed section 76a extending from the second cylindrical portion 78a whereas the second constricted portion 68a includes a straight section 74a extending from the second cylindrical portion 78a.

As shown in FIG. 2, to insert the contacts 60a into the housing 2, the top row of contacts 60a are inserted through the rear face 12 into the upper row of contact apertures 26a, each contact 60a sliding forward until the forward portion 64a abuts the shoulder 32a which constricts the forward opening within the contact aperture 26a. Since the contact terminal 60a is larger than the constricted opening of each cavity 26a at the mating face 10, each terminal 60a can only be inserted from the rear. As the contact 60a is inserted into the aperture 26a, the forward portion 62a contacts the ramped portion 20a of the contact latch 18a, causing the latch 18a to rise up and slide over the contact 60a. When the contact 60a is fully inserted, the contact latch locks in place, surface 20a abutting surface 80a of the contact 60a, and surface 22a of latch 18a locked against surface 82a of contact 60a, as shown in FIG. 3. The lower row of contacts 60b are installed in the same manner as the upper row of contacts 60a, the contact forward portion 62b abutting the shoulder 32b, and latch 18b locked against contact edge 82b.

Figure 5:
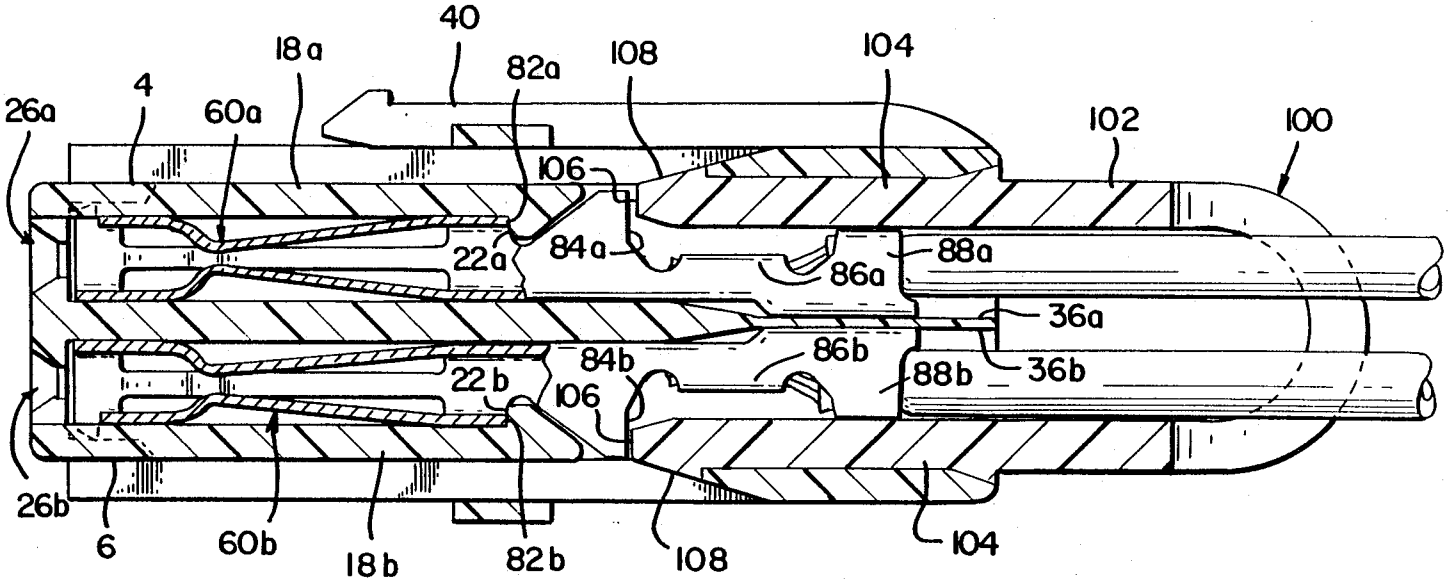
FIG. 5 is a cross-sectional view through lines 5—5 of FIG. 1.

To assure that the terminals 60a, 60b are fully forward within the respective apertures 26a, 26b, a terminal positioning insert 100 is employed. As best shown in FIG. 3, the insert 100 is installed from the rear of the housing, and inserted until the latches 108 lock into latching edge 16. When fully inserted, surfaces 106 bear against surfaces 84a, 84b of the contacts assuring that the contacts are fully forward, and contact latches 18a and 18b are engaged, as shown in FIG. 5.

If the contacts 60a, 60b are to be removed, the insert latch 108 and the contact latches 18a, 18b are accessible from the exterior of the housing, as shown in FIG. 1. Thus, the contacts 60a, 60b are easily removed. To prevent overstressing the contact latches 18a, 18b by bending them too far outward, the housing includes anti-overstress members 24a, 24b which limit the outward deflection of the contact latches 18a, 18b. When the contact terminals 60a, 60b are fully inserted in cavities or apertures 26a, 26b, further forward movement is prevented by engagement of the forward portions 64a, 64b with the constricted openings defined by shoulders 32a, 32b. The locking surfaces 22a, 22b on the contact latches 18a, 18b engage contact locking edges 82a, 82b to prevent rearward movement. Since the contact latches 18a, 18b are placed in tension by attempted rearward movement of the contact terminals 60a, 60b, the contact latches 18a, 18b are not required to bear any critical compressive loads, which means that buckling of the contact latches 18a, 18b is not critical. Cantilever contact latches 18a, 18b which are required to bear only tensile loads can have a smaller cross-sectional area than cantilever latches which would be required to withstand equivalent loads in compression. Therefore, the size of the latches can be reduced which in turn allows a reduction in the size of the connector and in the centerline spacing between adjacent contact terminals 60a or 60b and cavities 26a or 26b, and in the spacing between rows of terminal cavities 26a and 26b.

Figure 4:
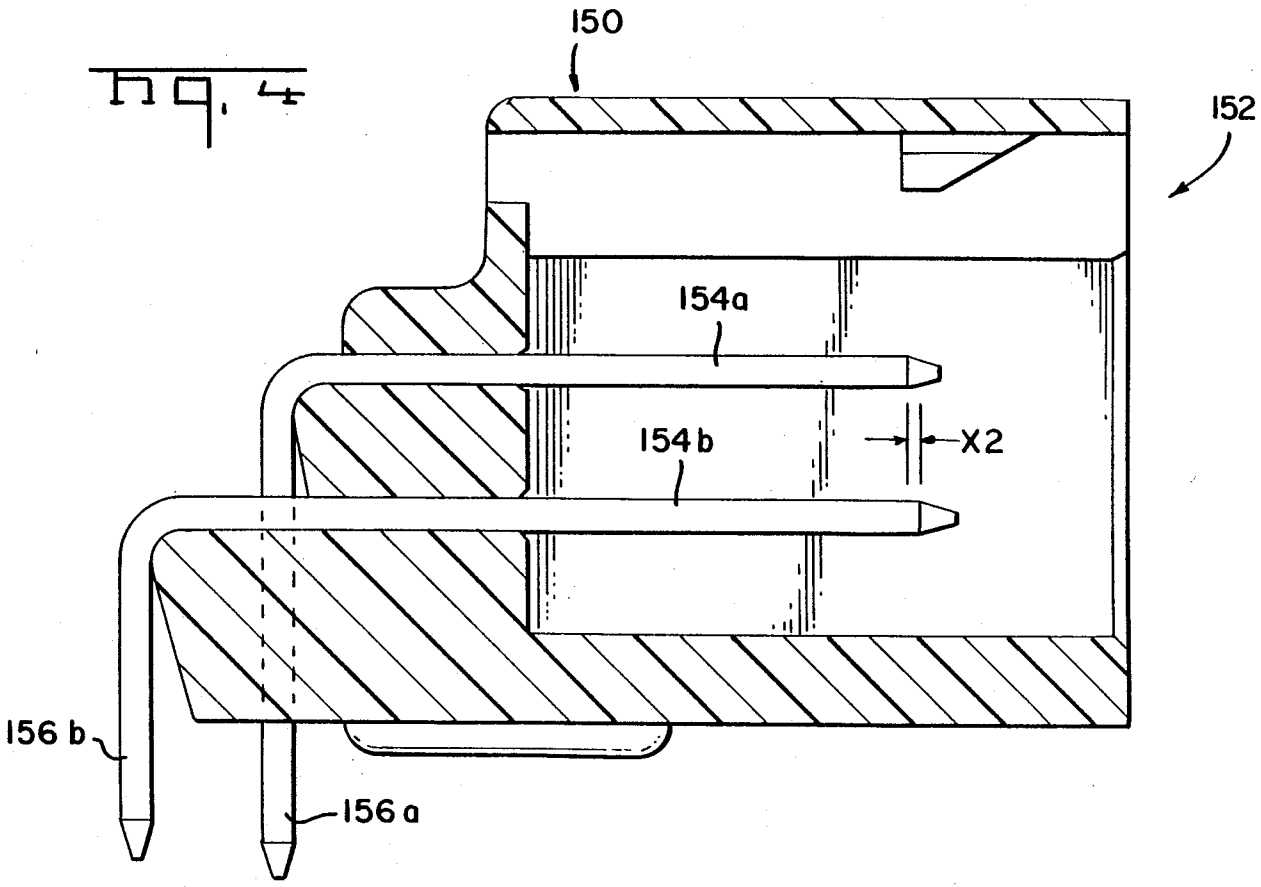
FIG. 4 is a cross-sectional view of the header through lines 4—4 of FIG. 1.

Once all contacts are loaded within the receptacle housing and the terminal positioning insert is in place, the receptacle is interconnectable with a header assembly, such as 150, shown in FIG. 1. As the square posts 154a, 154b as shown in FIG. 4 are dimensioned as small as 0.025 inch on a side, the contacts must be designed to make contact with the 0.025 inch square post with enough contact force to maintain electrical continuity.

Figures 7A, 7B, 7C, 7D:
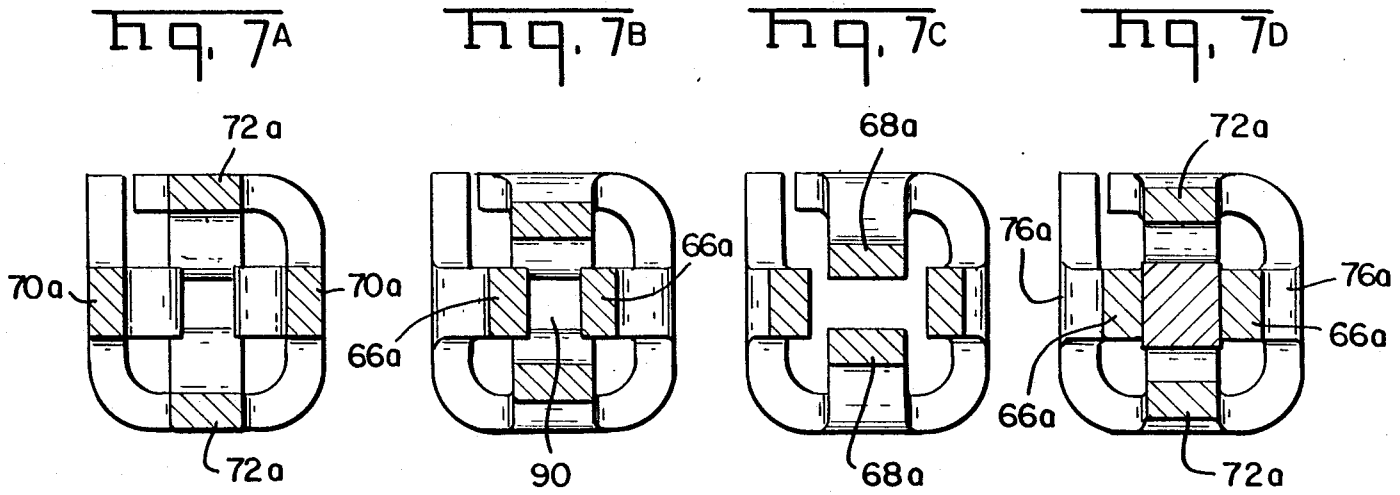

As designed, the first constricted portion 66a is axially offset by a distance $X_1$ from second constricted portion 68a, as shown in FIG. 6. This allows the constriction of each portion 66a, 68a to be closer to the axial centerline than possible had the constriction been at the same axial location. As shown in FIG. 7B, each beam section is wider than it could have been had the constriction been at the same axial position, resulting in a high normal force contact for a contact having a small envelope, resulting in a high density connector.

As shown in FIG. 7B, the contact opening 90 is square with each side smaller than the widths of the beam portions. Had the constriction of each pair of parallel beams been at the same axial opening, the width of each beam would have to be equal to or less than the width of the opening. As the beams are allowed to be wider, the contact force is kept high, which allows the contact envelope to be kept relatively small and thereby creates a high density connector.

As the constricted portions 66a, 66b are closely spaced together, the normal force on a mating post is relatively high. As shown in FIGS. 7B and 7C, at the constrictions the spacing between the opposed beams is less than the width of the beams. Thus, the deflection of the beams when the post is inserted is greater than the deflection of the beams in a design where the constrictions are at the same axial locations. The increased deflection of the beams in the instant design relatively increases the normal force on the electrical post.

Also, as the constricted portions of the contacts are axially offset, and as the square post terminals within the header are also axially offset, the insertion force required to mate the header and receptacle is substantially reduced. It should be noted that in the preferred embodiment, the axial offset $X_2$ between the upper and lower pins 154a and 154b, respectively, is less than the axial offset $X_1$, between the constricted portions 66, 68, although the reverse situation could be arranged.

In most connectors which include a plurality of contacts mounted within a receptacle, all contacts mate with their respective pins or posts simultaneously. The force required to overcome the preload on the contacts and to physically spread the beams apart, the insertion force, tends to be high, often causing the contacts, pins, or the latches within the housings which hold the contacts and pins in place to become overstressed. For example, a connector which includes 20 contacts mating with respective square posts 0.025 inch on a side would have a maximum insertion force of 32 pounds force, stabilizing to a sliding friction force of 20 pounds force.

Figure 9A:
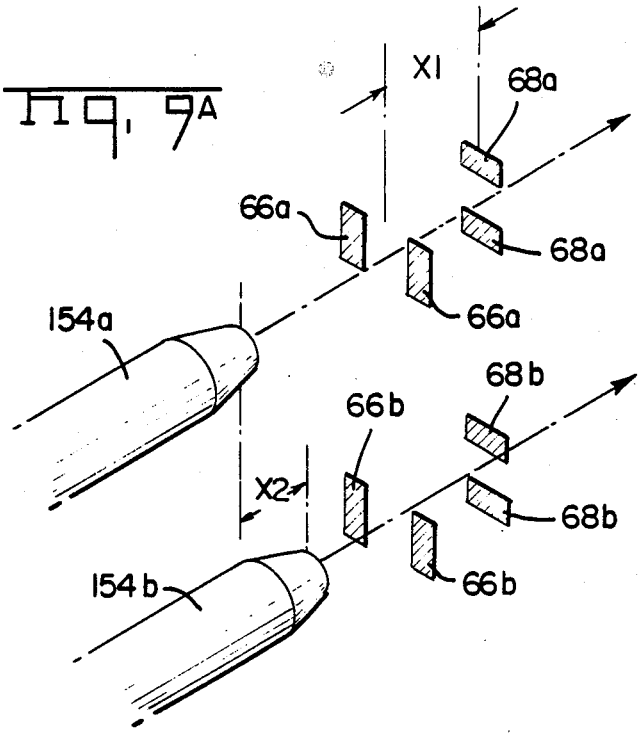
FIG. 9A is a diagrammatical view of the mating of the post and contact showing instantaneous cross-sections of the first and second constricted portions.
Figure 9B:
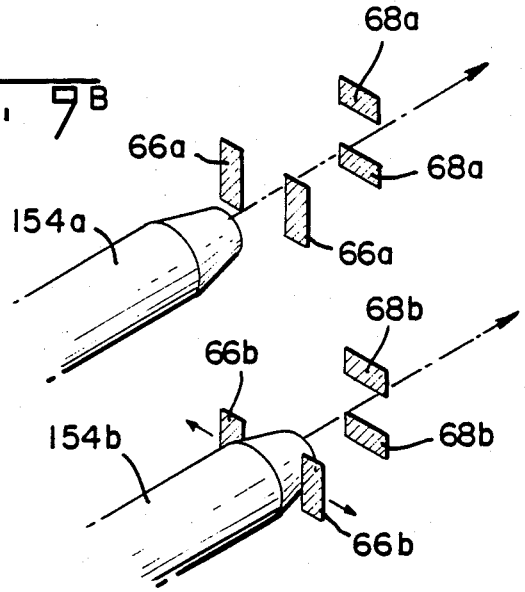
FIG. 9B is similar to FIG. 9A showing a first post mating with a lower first constricted portion.
Figure 9C:
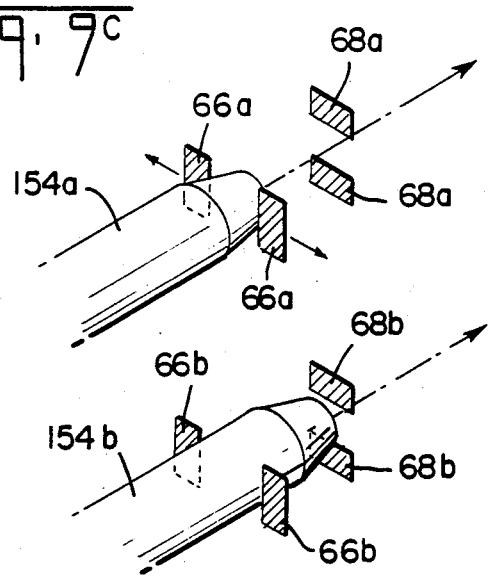
FIG. 9C is similar to FIG. 9A showing a second post mating with an upper first constricted portion.
Figure 9D:
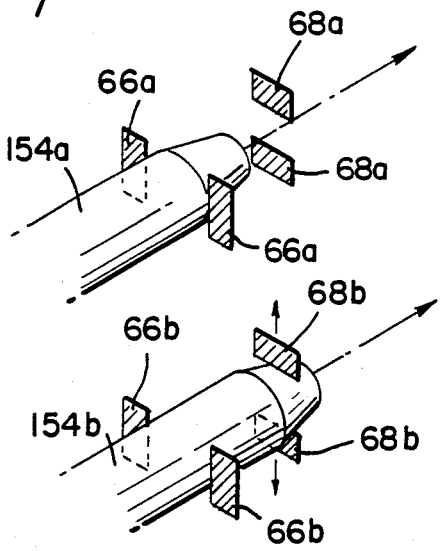
FIG. 9D is similar to FIGS. 9A showing the first post mating with a lower second constricted portion.
Figure 9E:
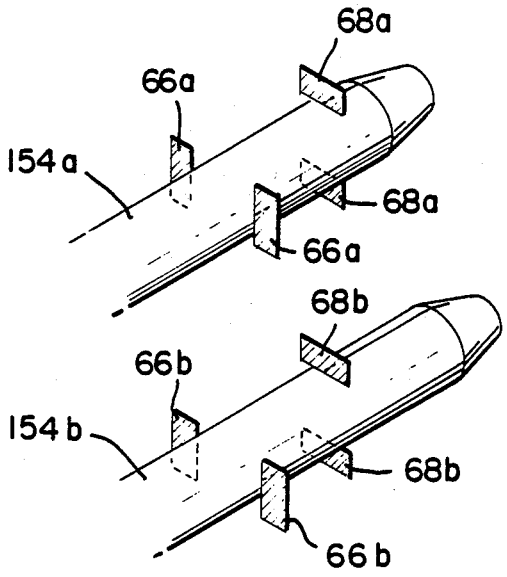
FIG. 9E is similar to FIG. 9A showing the second post mating with the upper second constricted portion.

In the instant design, however, as the constricted portions 66, 68 and the posts 154a, 154b are axially staggered, the insertion force is in a stepped sequence. As shown in FIGS. 9A through 9E, the mating of the contact constricted portions 66, 68 and the posts 154a, 154b is shown in diagrammatical fashion. FIG. 9A shows the posts 154a, 154b and constricted portions 66a, 68a, 66b, 68b aligned for insertion. As shown in FIG. 9B, lower post 154b begins to contact the lower constricted portion 66b. Referring now to FIG. 9C, the upper post 154a begins to contact the first constricted portion 66a of the upper contact 60a. As shown in FIG. 9D, the lower post 154b begins to mate with constricted portion 68b. Finally, the upper post 154a mates with constricted portion 68a, as shown in FIG. 9E. Using the same example as before, that is, a receptacle having 20 contacts mating with a header having 0.025 inch square posts requires a maximum total insertion force of 24.5 pounds force. The reduction in insertion force is due to the stepped sequence of mating the contacts and posts.

If the constricted portions of the contact are axially aligned, and if the header posts are also aligned, all posts hit the contact constricted portions simultaneously, causing the insertion forces of each post and contact combination to be additive. However, in the instant design, when the contact constricted portions are axially offset and when the header posts are axially offset, the posts hit the contacts in a four stepped sequence, as illustrated in FIGS. 9A–9E. After each contact and post are mated, the insertion force drops off to the sliding friction force of the mated contacts and posts. Thus, the maximum insertion force of the instant invention is the addition of the sliding friction force of all contacts and posts, and the force required to mate only the last posts and contacts of the four stepped sequence. In the prior art design where all posts and contacts hit simultaneously, the total insertion force is the addition of the sliding friction force of all contacts and posts mated and the force required to mate all posts and contacts simultaneously. Thus, the instant invention substantially reduces the maximum insertion force between the header and receptacle.

Figure 10:
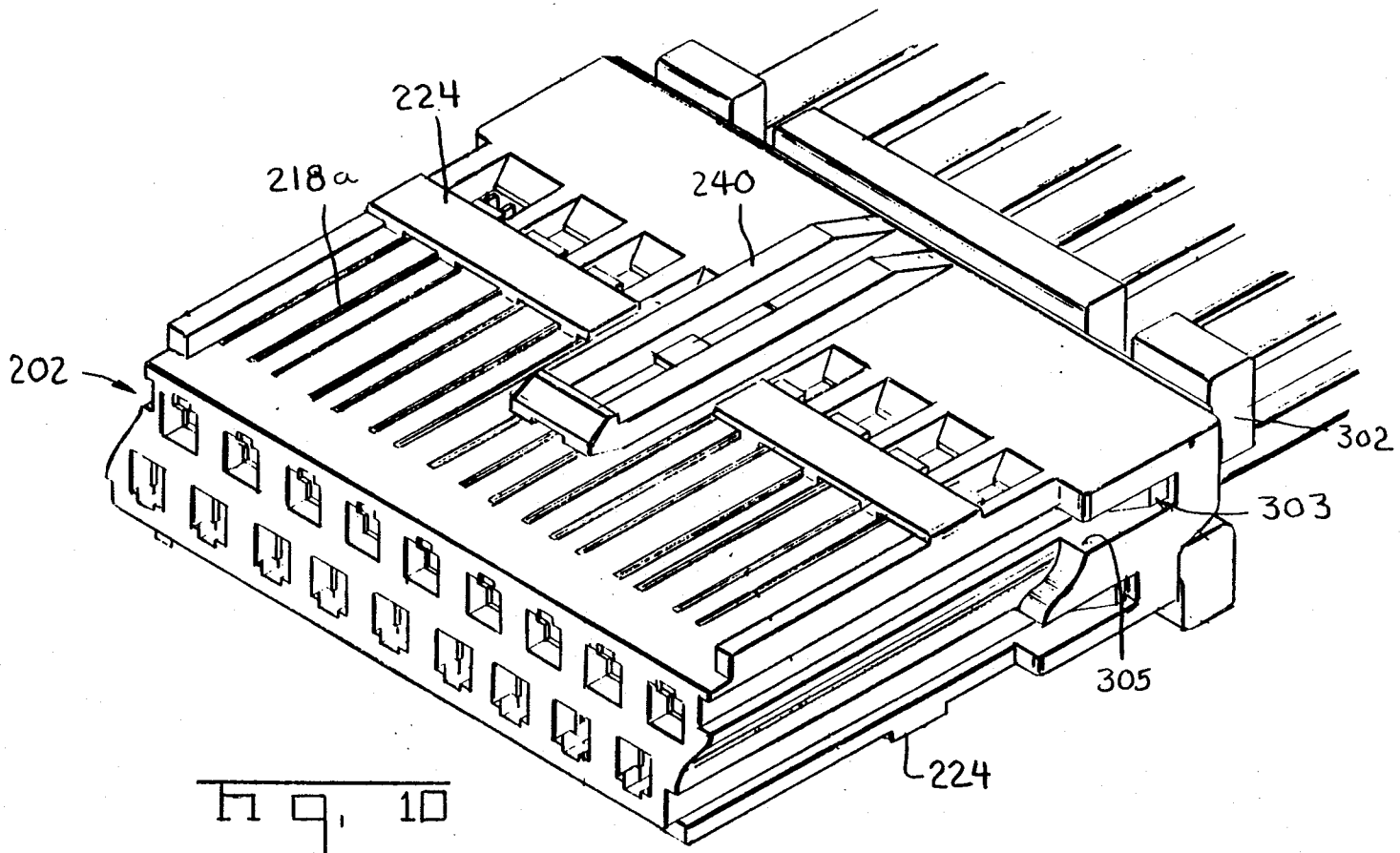
FIG. 10 is a perspective view of a second embodiment.

The first embodiment shown in FIGS. 1–5 constitutes an electrical connector having three side-by-side cavities 26a or 26b in two parallel rows. The second embodiment of FIG. 10 constitutes an eighteen position two row receptacle connectors 202. Note that the upper overstress member 224 extends transversely over a plurality of cantilever contact latches 218a. The lower overstress member 224 similarly extends over a plurality of contact latches but is not interrupted by a receptacle latch 240. The terminal position assurance insert 302 of the second embodiment also differs from terminal position assurance insert 102 of the first embodiment. Latches 303 are located on the side of each insert 302 and these latches snap into recesses 305 at the rear of the housing when fully inserted.

Figure 11:
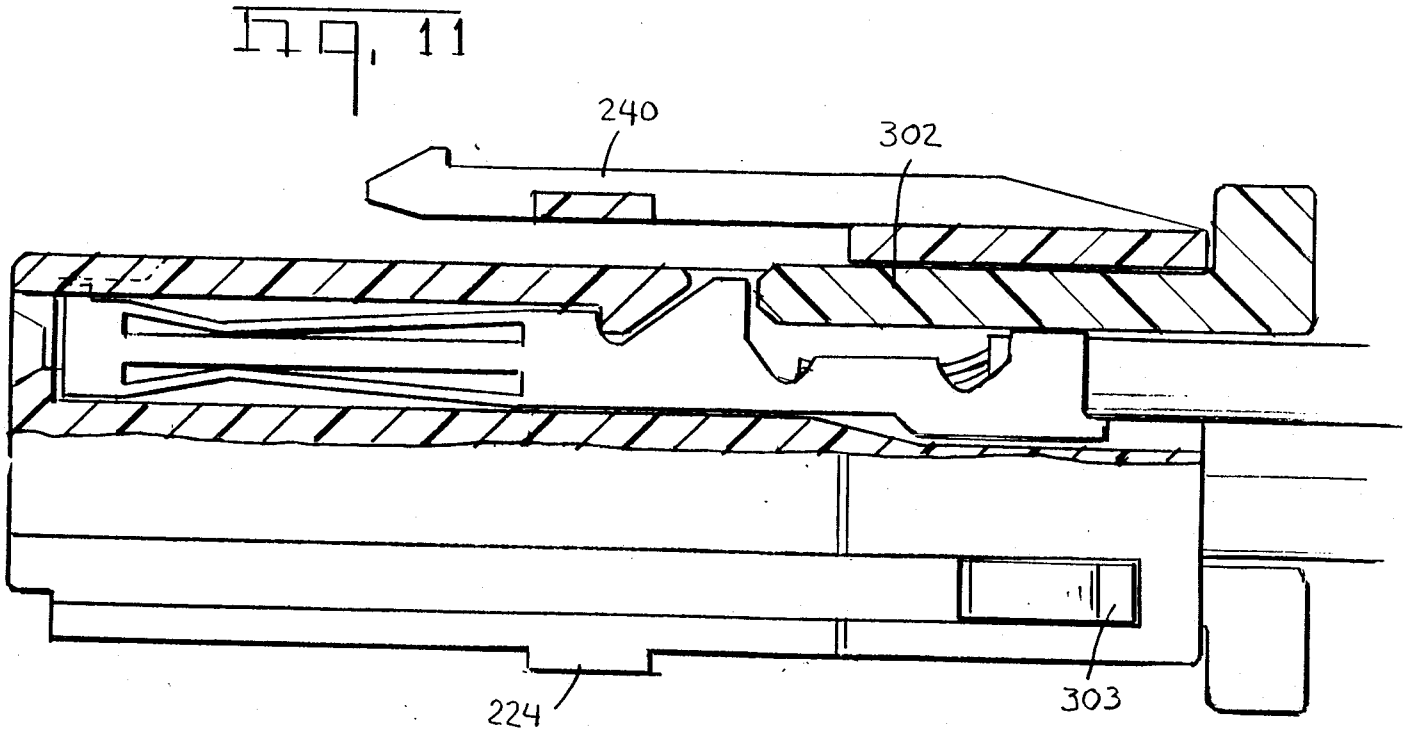
FIG. 11 is a sectional view of the embodiment of FIG. 10.

As shown in FIGS. 5 and 11, terminal position inserts 102 and 302 engage the contacts 60a, 60b on the outer edge thereof. In other words, two rows of contact terminals are located between spaced apart terminal position insert portions 104 in FIG. 5 and 302 in FIG. 11. The forward portion of terminal position insert fingers 104 and terminal position insert 302 engage the vertical locking surface 84 on the contacts 60a, 60b when the terminal position inserts 102 and 302 are inserted from the rear of the insulative housing. The cantilever contact latches 18a, 18b and 218a of the two embodiments, extending from the mating end are also located outwardly of the rows of contacts 60a, 60b. Contacts 60*a*, 60*b* are positioned in the housing so that ramped contact surfaces 80*a*, 80*b* and contact locking surfaces 84*a*, 84*b*, comprising edges of a protruding tab, face outwardly. With the contacts positioned in this manner, locking surfaces 22*a*, 22*b* on the ends of the contact latches 18*a*, 18*b* and corresponding surfaces on the latches 218*a* engage a portion of the exterior surface of the contacts 60*a*, 60*b* in front of the outer contact ramped surfaces 80*a*, 80*b* and outer contact locking surfaces 84*a*, 84*b*. When inserted from the rear, the terminal position inserts 102 and 302 are also located on the outer side of contacts 60*a* and 60*b* and are positioned behind the contact locking surfaces 84*a* and 84*b*.

Although the instant invention is disclosed by way of preferred embodiments, other embodiments are available. Particularly, in the contact 60*a*, although shown as having an axial offset $X_1$ as shown in FIG. 6, leaving a square opening 90 as shown in FIG. 7B, the constricted portions could actually be further offset axially to allow varied amounts of spacing. As shown in FIG. 8A, the constricted portions could be axially offset to the extent where the opposing beams are actually contacting each other, leaving no opening at all, as shown in FIG. 8B. The altered components of the embodiment shown in FIGS. 8A and 8B refer to respective primed numerals.

We claim:

1. A multicontact electrical connector comprising:

a plurality of contact terminals, each having a contact portion and a conductor termination portion, an insulative housing having a plurality of cavities extending between a rear face and a mating face, each cavity being dimensioned to receive one contact terminal, each cavity having a constricted opening adjacent the mating face, the contact terminal being larger than the constricted opening so that each contact terminal can only be inserted into a corresponding cavity through the rear face of the housing;

the housing further including a plurality of resilient cantilever beam contact latches each having a fixed end adjacent the mating face and a free end between the mating face and the rear face, the free end of each cantilever beam contact latch being accessible from the exterior of the housing, the free end being outwardly deflectable for disengagement from the corresponding contact terminal, each cantilever beam contact latch having a ramp surface at the free end and a locking surface adjacent the ramp surface, the ramp surface and the locking surface extending inwardly from the cantilever beam contact latch for engagement with a corresponding contact terminal, the corresponding contact terminal engaging the ramp surface during insertion to flex the cantilever beam contact latch outwardly, the locking surface engaging the contact terminal upon complete insertion, each latch comprising at least a portion of an exterior wall of a corresponding cavity;

first overstress means on the housing extending transversely between the fixed end and the free end of the plurality of cantilever beam contact latches on the exterior of the housing; and a receptacle latch located on the exterior of the housing adjacent at least one cantilever beam contact latch, the receptacle latch having second overstress means thereon extending transversely relative to the at least one cantilever beam contact latch, whereby each resilient cantilever beam contact latch is outwardly deflectable to allow insertion of a corresponding contact terminal into a corresponding cavity.

2. A multicontact electrical connector comprising:

a plurality of contact terminals, each having a contact portion and a conductor termination portion, each contact terminal having a protruding tab between the contact portion and the conductor termination portion, the protruding tab having a ramped contact surface adjacent the contact portion and a locking surface adjacent the conductor termination portion;

an insulative housing having a plurality of cavities in two rows extending between a rear face and a mating face, each cavity being dimensioned to receive one contact terminal inserted through a rear face of the housing, the terminals being positioned in the two rows of cavities with the protruding tabs facing outwardly;

the housing further including a plurality of resilient cantilever beam contact latches each having a fixed end adjacent the mating face and a free end between the mating face and the rear face, each cantilever beam contact latch having a latch ramp surface at the free end and a latch locking surface adjacent the ramp surface, the ramp surface and the locking surface extending inwardly from the cantilever beam contact latch for engagement with a corresponding contact terminal, the corresponding contact terminal engaging the latch ramp surface during insertion to flex the cantilever beam contact latch outwardly, the latch locking surface engaging the contact terminal upon complete insertion, each latch comprising at least a portion of an exterior wall of a corresponding cavity; and terminal position insert means insertable into the housing from the rear thereof, the terminal position insert means including a forward portion located outwardly of the contact terminals in the two rows of cavities on opposite sides of the housing, the protruding tabs being positioned between corresponding terminal position insert means and corresponding resilient cantilever beam contact latches;

whereby each resilient cantilever beam contact latch is outwardly deflectable to allow insertion of a corresponding contact terminal into a corresponding cavity.

3. The multicontact electrical connector of claim 2 wherein the terminal position insert means is engagable with the locking surface on the protruding tab of a partially inserted contact terminal to move the terminal further into the cavity into locking engagement with the cantilever beam contact latches.

* * * * *